US012656093B2

(12) United States Patent
Hirvinen

(10) Patent No.: US 12,656,093 B2
(45) Date of Patent: Jun. 16, 2026

(54) ROCKET STAGE, A ROCKET AND A GLIDING PART

(71) Applicant: Raimo Hirvinen, Hyvinkää (FI)

(72) Inventor: Raimo Hirvinen, Hyvinkää (FI)

( * ) Notice: Subject to any disclaimer, the term of this patent is extended or adjusted under 35 U.S.C. 154(b) by 0 days.

(21) Appl. No.: 18/218,265

(22) Filed: Jul. 5, 2023

(65) Prior Publication Data

US 2024/0011750 A1 Jan. 11, 2024

(30) Foreign Application Priority Data

Jul. 11, 2022 (FI) ..... 20227100

(51) Int. Cl.
*F42B 15/36* (2006.01)

(52) U.S. Cl.
CPC ..... *F42B 15/36* (2013.01)

(58) Field of Classification Search
CPC . F42B 15/36; F42B 10/60; B64G 1/64; B64G 1/10; B64G 1/244; B64G 1/002; B64G 1/645; B64G 1/14
See application file for complete search history.

(56) References Cited

U.S. PATENT DOCUMENTS 2,656,136 A * 10/1953 Martin ..... B64C 35/00 244/35 R
3,706,281 A * 12/1972 Hatakeyama ..... F42B 15/36 102/378
4,667,899 A * 5/1987 Wedertz ..... F42B 10/14 244/3.28
4,802,639 A * 2/1989 Hardy ..... B64G 1/14 D12/342
5,186,419 A * 2/1993 Scott ..... B64G 1/2427 244/164
5,322,248 A * 6/1994 Ragab ..... B64G 1/36 244/158.9
6,494,406 B1 * 12/2002 Fukushima ..... B64G 1/645 244/173.3
7,093,799 B1 * 8/2006 Dulat ..... F42B 10/46 244/119
8,505,455 B2 * 8/2013 Fisch ..... F42B 15/36 102/377
8,519,312 B1 * 8/2013 Merems ..... F42B 15/36 244/119

(Continued)

OTHER PUBLICATIONS

Office Action from the Finnish Patent and Registration Office, Serial No. 20227100, dated Jan. 27, 2023.

*Primary Examiner* — Medhat Badawi
(74) *Attorney, Agent, or Firm* — BelayIP

(57) ABSTRACT

A rocket stage having a frame is disclosed. The frame includes a nose part and a mid-section part. The frame is configured to separate into two or more gliding parts after the stage has fulfilled its main purpose. After separation, the gliding parts glide down to the ground. The gliding part comprises a section of the nose part and a section of the mid-section part and a flat gliding surface alongside the section of the mid-section part. The slope of the nose part of the gliding part is steeper than the slope of the mid-section part of the gliding part. The air flows around the frame of the gliding part and a vortex forms above the upper edges of the gliding part, forcing the gliding part in the gliding position when it is in the atmosphere.

16 Claims, 5 Drawing Sheets

(56) References Cited

U.S. PATENT DOCUMENTS

| | | | | |
|---|---|---|---|---|
| 8,931,738 | B2 * | 1/2015 | White | F42B 15/10 244/129.4 |
| 10,054,411 | B2 * | 8/2018 | Quertelet | F42B 10/46 |
| 10,254,094 | B1 * | 4/2019 | Harrison | F42B 10/46 |
| 10,377,510 | B1 * | 8/2019 | Riskas | B64G 1/64 |
| 10,669,048 | B1 * | 6/2020 | Tanner | B64G 1/641 |
| 10,767,968 | B2 * | 9/2020 | Quertelet | F42B 10/46 |
| 2004/0108411 | A1 * | 6/2004 | August | F42B 12/58 244/2 |
| 2007/0018036 | A1 * | 1/2007 | Stephenson | B64G 1/14 244/36 |
| 2010/0282917 | A1 * | 11/2010 | O'Shea | B64U 30/12 244/49 |
| 2011/0297793 | A1 * | 12/2011 | Prampolini | B64G 1/006 244/158.9 |
| 2012/0328441 | A1 * | 12/2012 | Fogarty | A63H 33/18 416/204 R |
| 2013/0099049 | A1 * | 4/2013 | Reany | B64U 30/12 244/46 |
| 2015/0122942 | A1 * | 5/2015 | Hirvinen | B64C 1/0009 244/36 |
| 2018/0086454 | A1 * | 3/2018 | Cook | B64U 10/50 |
| 2018/0127114 | A1 * | 5/2018 | Salkeld | B64G 1/14 |
| 2019/0041178 | A1 * | 2/2019 | Choiniere | F42B 15/08 |
| 2019/0219373 | A1 * | 7/2019 | Pinoteau | F42B 10/02 |
| 2021/0094704 | A1 * | 4/2021 | Sheerin | B64G 1/006 |
| 2022/0169380 | A1 * | 6/2022 | Mehrgan | B64C 29/02 |
| 2022/0281593 | A1 * | 9/2022 | Stobbe | B64C 39/12 |
| 2023/0031950 | A1 * | 2/2023 | Creagh | F41G 9/02 |
| 2024/0011750 | A1 * | 1/2024 | Hirvinen | F42B 15/36 |

* cited by examiner

ROCKET STAGE, A ROCKET AND A GLIDING PART

CROSS REFERENCE TO RELATED APPLICATIONS

This application claims priority to Finnish patent application FI20227100, filed Jul. 11, 2022, the content of which is herein incorporated by reference.

BACKGROUND OF THE INVENTION

Field of the Invention

The invention relates to a rocket stage comprising an elongated frame, a nose and a tail, and the frame comprises a nosepart and a mid-section, and the nose part has a cone-like surface and the mid-section is at least partly cylindrical. The invention also relates to a rocket comprising at least one rocket stage and a gliding part.

Description of Related Art

A rocket stage is a part of a rocket. The stage contains its own engines, propellant and other systems for the rocket to work. Usually, when sending satellites and such to orbit, two or more rocket stages are used, but also single stage rockets are commonly used. The stage is jettisoned when it run out of propellant, and thus the mass of the remaining rocket decreases. Each successive stage can also be optimized for its specific operating conditions, such as the decreased atmospheric pressure at higher altitudes. It is a well-known fact that rockets and their parts are quite expensive, and therefore reusable stages are investigated by many space agencies and corporations. Previous designs for reusable rocket systems include earth lift-off boost stages that execute a short-range turn-around return to the launch site or a downrange site by ballistic, glide or powered flight with parachutes, vertical-touchdown, or horizontal airstrip recovery; earth lift-off single stage-to-orbit (SSTO) launchers to low earth orbit (LEO), which return to any earth site by ballistic, glide or powered flight with parachute, vertical-touchdown, or horizontal air strip recovery.

However, many of aforementioned techniques are unreliable and demand extremely precise engineering. There is a clear need for a simple, at least partially reusable rocket stage to reduce cost.

BRIEF SUMMARY OF THE INVENTION

The object of the invention is a solution that can significantly reduce the disadvantages and drawbacks of the prior art. In particular, the object of the invention is a rocket stage which have reusable frame parts.

The invention is a rocket stage having a frame. The frame comprises a nose part and a mid-section part. The frame is configured to separate into two or more gliding parts after the stage has fulfilled its main purpose. After separation, the gliding parts glide down to the ground. The gliding part comprises a section of the nose part and a section of the mid-section part and a flat gliding surface alongside the mid-section part. The slope of the nose part is steeper than the slope of the mid-section part. The air flows around the frame of the gliding part and forms also a vortex above the upper edges of the gliding part, forcing the gliding part into a gliding position when it is in the atmosphere. It must be noted that the mid-section part may also comprise end parts of the rocket stage, i.e. the tail parts.

When reference is made in the text to the upper or the lower parts or respective directions such as down or up, a situation is described in which the gliding part according to the invention is resting horizontally on a surface. Also, when reference is made to the vertical or horizontal directions or surfaces, the device is placed similarly.

In one embodiment of the invention is a rocket stage comprising an elongated frame, a nose and a tail, and the frame comprises a nose part and a mid-section part, and the nose part has a cone-like surface. In one advantageous embodiment of the invention, the frame on the mid-section part comprises several longitudinal side surfaces which side surfaces are approximately flat, and the frame is configured to come apart longitudinally as two or more through-like gliding parts, each having a nose end and a tail end. Each gliding part comprises part of the nose and part of the mid-section and one side surface on the gliding part is a gliding surface, and the gliding surface is positioned symmetrically in relation to the edges of the gliding part. The centre of gravity of the gliding part is closer to the nose end than to the tail end. Each gliding part comprises control systems for steering or enhancing the gliding properties of the gliding part, and the control systems comprise at least movable surfaces.

In one embodiment of the rocket stage, the angles between the longitudinal side surfaces of the mid-section are approximately equal on a transverse plane.

In a second embodiment of the rocket stage, the widths of the longitudinal side surfaces of the mid-section part are approximately equal to each other on a transverse plane.

In a third embodiment of the rocket stage, the relation between the width of the nose part and the length of the nose part is 1:2±30%. The inventor has discovered that these ratios produce good results for the gliding part orientating itself in the gliding position after the frame has come apart.

In a fourth embodiment of the rocket stage, the width of the gliding part is the transverse distance of the edges of the gliding part at the mid-section part of the gliding part, and the relation between the width of the gliding part, the length of the nose part on the gliding part and the length of the mid-section part on the gliding part is 1:2:5±30%. The inventor has discovered that these ratios produce good gliding properties for the gliding part.

In a fifth embodiment of the rocket stage, the control systems comprise several gliding support wings, and the gliding support wings are attached on the walls of the mid-section part, and the gliding support wings are positioned in such a way that at least some of the gliding parts comprise at least two gliding support wings on the opposing inner walls of the gliding part, and the gliding support wings are configured to swing at least partly outside of the gliding part to provide additional surface area and thus improve the gliding properties of the gliding part.

In a sixth embodiment of the rocket stage, the gliding support wings are configured in such a way that when the gliding support wings are extended in order to improve the gliding properties, the gliding support wings comprise parts that are approximately on the parallel plane as the gliding surface or diverge at most 60 degrees from the plane formed by the gliding surface.

In a seventh embodiment of the rocket stage, the gliding support wings affixed to inside of the frame or outside of the frame. In some embodiments, the positions of the gliding support wings or parts of the gliding support wings are adjustable during the glide.

In an eighth embodiment of the rocket stage, the nose comprises several movable nose surface parts on the outer surface of the nose part, and the nose surface parts are positioned in such a way that each gliding part comprises at least one nose surface part, and the nose surface part functions as a canard arrangement for the gliding part during gliding and landing and said nose surface parts form at least part of the control systems.

In a ninth embodiment of the rocket stage, the angle between the planes of the nose part and the gliding surface in the gliding part is 10 to 45 degrees from the plane of the gliding surface from the plane of the gliding surface. The inventor has discovered that this feature improves the gliding and landing properties of the gliding part.

In a tenth embodiment of the device, the gliding parts are configured to partly overlap when they form the frame.

In one embodiment of the invention is a rocket comprising at least one rocket stage. In one advantageous embodiment of the invention, the rocket stage is as described earlier.

In one embodiment of the rocket, the rocket stage comprises systems for the rocket, and at least some of the systems are configured to be jettisoned when the frame of the rocket stage separates into the gliding parts.

In one embodiment of the invention is a gliding part. In one advantageous embodiment of the invention, the gliding part is a part of frame of a rocket stage, and the gliding part is a through-like structure having a nose end and a tail end, and the through-like inner part of the gliding part is at least partly open. The gliding part comprises a nose part of the gliding part and a mid-section part of the gliding part. The nose part of the gliding part has a cone-like surface part and the mid-section part of the gliding part has a cylindrical surface part with polygonal cross section. The mid-section part of the gliding part comprises several longitudinal side surfaces, which side surfaces are approximately flat and one of the side surfaces is a gliding surface and the gliding surface is positioned symmetrically in relation to the edges of the gliding part. The centre of gravity of the gliding part is closer to the nose end than to the tail end, and the gliding part comprises control systems for steering or enhancing the gliding properties of the gliding part, and the control systems comprise at least movable surfaces. The nose part, the gliding surface and at least partially hollow inner part of the gliding part provide the gliding properties for the gliding part when it is in the atmosphere.

In one embodiment of the gliding part, the gliding part is configured to land and to be reused.

It is an advantage of the invention that it provides a shape for a part rocket stage frame, which shape can glide down from space or the upper atmosphere to the ground for landing and parts of the rocket stage be reused.

One advantage of the invention is that it is quite simple and it does not require complicated components. Also, the parts that glide down orient themselves automatically for gliding.

It is a further advantage of the invention that it can be easily optimized for rocket systems of different sizes. The invention also provides a significant cost reduction in rocket systems.

BRIEF DESCRIPTION OF THE SEVERAL VIEWS OF THE DRAWINGS

Further advantages features and details of the various embodiments of this disclosure will become apparent from the ensuing description of a preferred exemplary embodiment or embodiments and further with the aid of the drawings. The features and combinations of features recited below in the description, as well as the features and feature combination shown after that in the drawing description or in the drawings alone, may be used not only in the particular combination recited but also in other combinations on their own without departing from the scope of the disclosure.

In the following, the invention is described in detail. The description refers to the accompanying drawings, wherein.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that "at least one of "A, B, and C" should be understood as including not only one of A, only one of B, only one of C, or any combination of A, B, and C.

The embodiments in the following description are given as examples only and some-one skilled in the art can carry out the basic idea of the invention also in some other way than what is described in the description. Though the description may refer to a certain embodiment or embodiments in several places, this does not mean that the reference would be directed towards only one described embodiment or that the described characteristic would be usable only in one described embodiment. The individual characteristics of two or more embodiments may be combined and new embodiments of the invention may thus be provided. It must be noted that in the figures some dimensions and relations between sections may be exaggerated or otherwise changed for overall clarity.

Figure 1A:
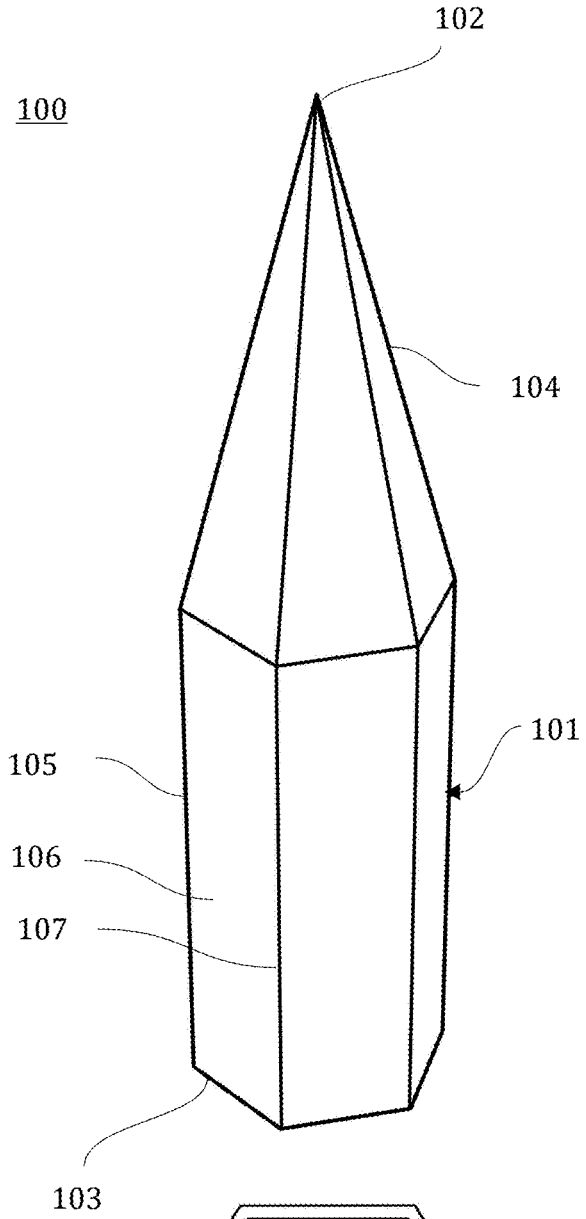
FIG. 1*a* shows an example of a rocket stage according to the invention.
Figure 1B:
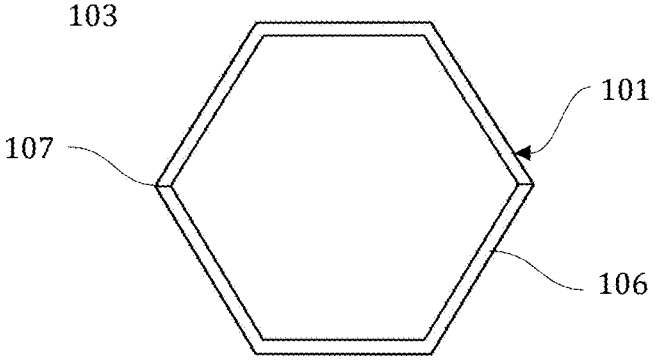
FIG. 1*b* shows a cross section of the rocket stage of FIG. 1*a*.

FIG. 1*a* shows an embodiment of a rocket stage 100 and FIG. 1*b* shows a cross section of the rocket stage. The rocket stage is a part of a rocket containing several stages or the rocket stage is carrying some payload.

The rocket stage 100 comprises a frame 101, a nose 102 and a tail 103. The frame is an elongated structure and comprises a nose part 104 and a mid-section part 105. In this embodiments, the tail is included in the mid-section part.

The nose part has a cone-like surface and the mid-section part is at least partly cylindrical. The cross section of the cylindrical mid-section part has polygonal shape. In this example the nose has a sharp point, but the nose can be shaped differently as well. For example, there are embodiments where the nose is flat or approximately flat, i.e., the nose part is cone-shaped with a cut tip. The frame is hollow and contains systems of the rocket stage. Some parts of the systems may extend outside of the frame, such as the nozzles of the engines. This mean that the mid-section is between the nozzles of the engines and the nose part. For increasing clarity, those engine parts are not shown in the Figures. In some embodiments, there may also be cargo inside of the rocket stage.

The mid-section part 105 has a first end of the mid-section part and a second end of the mid-section part. The nose part 104 is on the first end of the mid-section part. The frame 101 on the mid-section part 105 comprises several longitudinal side surfaces 106, i.e., they extend from the first end of the mid-section part to the second end of the mid-section part. The side surfaces are approximately flat. There are fold lines 107 between adjacent side surfaces. The fold lines are straight and, in this example, parallel. The cross section of the mid-section part is polygonal. In this example, the polygon is regular, i.e. the angles between the longitudinal side surfaces of the mid-section part and the widths of the side surfaces of the mid-section part are approximately equal on a transverse plane. This is shown in FIG. 1*b*. There are embodiments where the cross section of the mid-section part is shaped differently. For example, in some embodiments the cross section is ellipsoidal, in which case the orthogonal diameters do not have the same dimensions. Also, in some embodiments the diameters of the cross sections of the mid-section part change in the longitudinal direction in a way that that the diameters near the second end of the mid-section part are greater than the diameters near the first end of the mid-section part. However, the slope of the mid-section part is significantly smaller than the slope of the nose part. There are embodiments where the mid-section part comprises several distinct side surfaces and the frame of the mid-section part between the flat side surfaces is curved.

In this example, the nose part 104 comprises side surfaces 106 that correspond to those in the mid-section part 105. This means that the fold lines 107 in the mid-section part and in the nose part are continuous, i.e. the ends of the fold lines join at the border between the mid-section part and the nose part. The cross section of the nose part is polygonal. In some embodiments, the cross section of the nose part is at least partly curved.

The frame 101 of the rocket stage 100 is configured to come apart as two or more gliding parts. This is done when the rocket comprising the rocket stage has reached the desired height and the rocket stage is detached from the rocket or the payload that is carried by the rocket stage is jettisoned. The gliding parts are elongated structures, and each gliding part comprises part of the nose part 104 and part of the mid-section part 105 and at least one side surface 106. The side surface on the gliding part is a gliding surface. When the descending gliding part is inside the atmosphere, the air currents around the gliding part force the gliding part into a gliding position, providing lift during the glide. The systems inside the frame can be jettisoned from the rocket stage and, for example, can be parachuted down, or they can be divided to be carried down by the gliding parts. The gliding position for the gliding part is approximately horizontal and the nose is somewhat down from horizontal level. The gliding is controlled by control systems for steering or enhancing the gliding properties of the gliding part, and the control systems comprise at least movable surfaces. These controls systems are movable parts of frame of the gliding part or winglike structures. Moving these control systems cause the gliding part to change its course, and it can be steered towards the ground and a landing place.

Figure 2A:
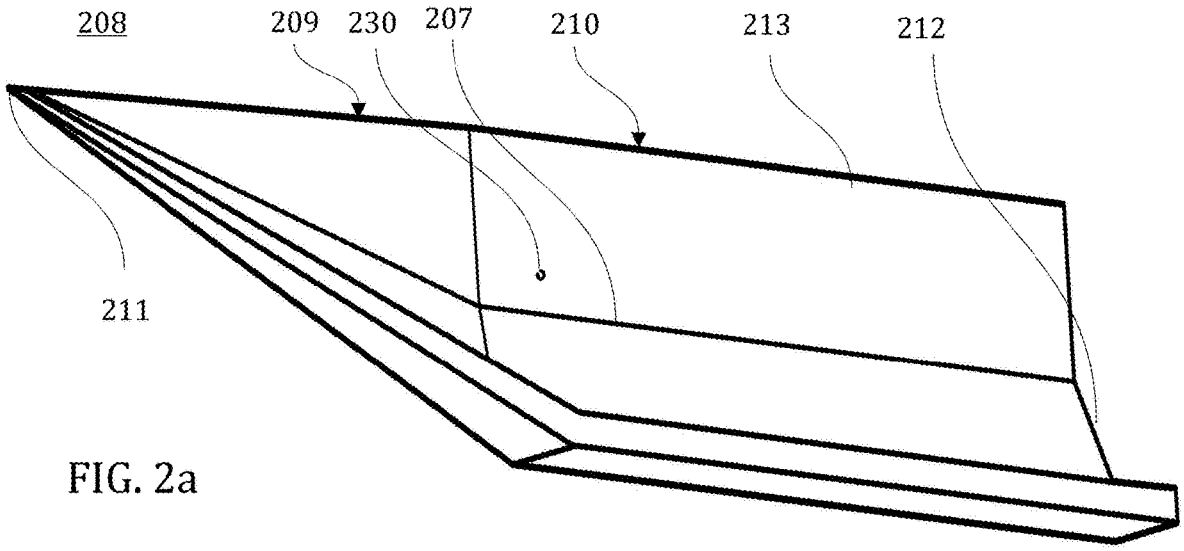
FIG. 2*a* shows an example of a gliding part according to the invention.
Figure 2B:
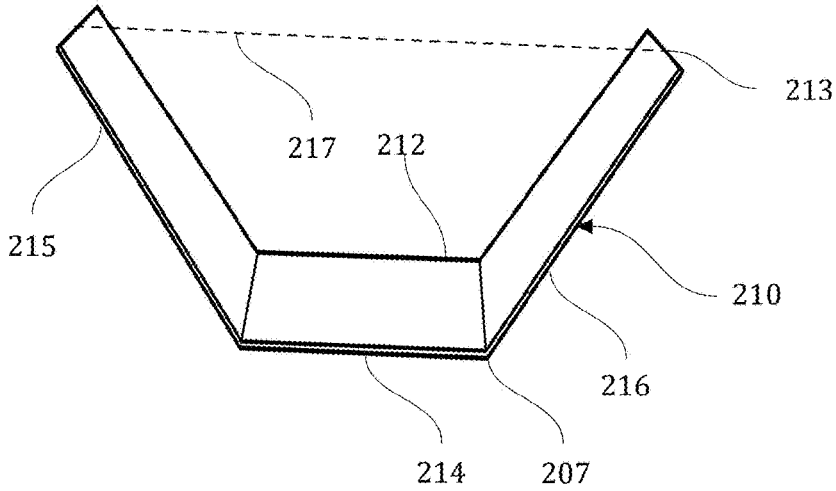
FIG. 2*b* shows a transverse cross section of the gliding part of FIG. 2*a*.
Figure 2C:
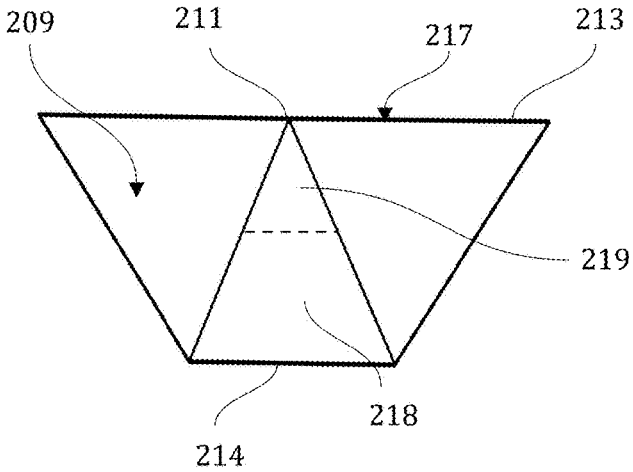
FIG. 2*c* shows the nose end of the gliding part of FIG. 2*a* as seen from the front.

FIG. 2 shows an embodiment of a gliding part 208. FIG. 2*a* shows the gliding part in a horizontal gliding position as seen from the side, FIG. 2*b* shows the transverse cross section of the mid-section part of the gliding part as seen from slightly above, and FIG. 2*c* shows the gliding part as seen from the front. Two or more gliding parts form a frame of a rocket stage, and the gliding parts are affixed to each other in such a way that they can be separated when the rocket stage has completed it task, delivered its payload, or the rocket stage has detached from the rest of the rocket. In some embodiments, the separation of the gliding parts is achieved with explosive bolts. Naturally, other techniques can be used. In this example, there are two gliding parts that form the frame of the rocket stage.

In FIG. 2*a*, the gliding part 208 is in a position resembling the gliding position and it can be interpreted that the gliding part is resting on a virtual surface longitudinally, i.e. the longitudinal axis of the gliding part is parallel to said virtual surface.

The gliding part 208 has a frame of the gliding part. The frame of the gliding part comprises a nose part of the gliding part 209 and a mid-section part of the gliding part 210. The gliding part has a nose end 211 and a tail end 212. The gliding part is a through-like structure and it has edges 213 of the gliding part, a bottom of the gliding part, an upper surface 217 of the gliding part, which surface is virtual or real, and sides of the gliding part, namely a first side 215 and a second side 216. In this example the gliding part is a half of the rocket stage, i.e. two gliding parts form the rocket stage. The height of the gliding part is the vertical distance between the level of the edge and the level of the bottom of the gliding part. The width of the mid-section part of the gliding part is the horizontal distance between the edges of the first side and the second side. The width of the mid-section part of the gliding part is also the width of the gliding part. On the mid-section part of the gliding part there is at least one side surface of the rocket stage or part of it, and at one of these side surfaces is a gliding surface 214. The gliding surface forms the bottom of the gliding part and provides main part of the lift.

In this example, the mid-section part of the gliding part 210 comprises three sides: the first side 215, the second side 216 and the gliding surface 214. Between the sides and the gliding surface are fold lines 207. In this example, the longitudinal axis of the sides and the gliding surface are approximately parallel.

The nose part of the gliding part 209 is a converging shape comprising three sides that are essentially flat. Between adjacent sides are fold lines 207. The upper edges of the nose part, the fold lines and said sides converge towards the nose end 211. In this example the nose end is sharp. There are embodiments where the nose end is shaped differently. It can be, for example, rounded or flat as well. The nose end is at the same level as the virtual upper surface 217 of the gliding part. There are embodiments where the nose end is not at the same level as the upper surface of the gliding part.

The gliding surface 214 is positioned symmetrically in relation to the edges 213 of the gliding part. This means that both sides, the first side 215 and the second side 216 that surround the gliding surface are of the same size and are positioned similarly.

The gliding part 208 and its parts, including equipment and other auxiliary components fastened to the gliding part, are configured in such way that the centre of gravity 230 of the gliding part is closer to the nose end 211 than to the tail end 212, i.e. when the gliding part is virtually divided to the nose side and the tail side which are equally long, the centre of gravity of the gliding part is on the side of the nose. This means that the nose end is at a lower level than the tail end when the gliding part is descending in atmosphere. This causes the gliding part to dive and orient itself in a gliding position. Also, diving maintains sufficient velocity and thus assists the gliding part in staying in the gliding position. The gliding part comprise components for controlling the glide. These are control systems for steering or enhancing the gliding properties of the gliding part, and the control system comprise at least movable surfaces.

In this embodiment, there is a support gliding surface 218 in the nose part 209 of the gliding part. The support gliding surface is flat and converges toward the nose end 211. The support gliding surface is a continuous surface to the gliding surface 214 and is on the bottom side of the gliding part 208. In some embodiments the angle between the support gliding surface and the gliding surface is 10 to 45 degrees from the plane of the gliding surface degrees from the plane of the gliding surface. In some embodiments, the most advantageous angle values for gliding properties between the support gliding surface and the gliding surface are in range 15 to 35 degrees from the plane of the gliding surface. It must be noted that these angles apply even if there is no distinct support gliding surface, but the nose part comprises, for example, a curved surface. In some embodiment, the nose part is partly domelike. In this embodiment, the support gliding surface 218 comprises a movable surface 219 of the support gliding surface. This works at least a part of the control system.

The inventor has discovered some advantageous relationships between the gliding part 208 dimensions that provide good gliding properties. In some embodiments, the relation between the width of the nose part 209 and the length of the nose part on the gliding part 208 is 1:2±30%. For example, if the length of the nose part is 5 metres, the width of the nose part is 2.5 metres. Both of these values can vary by 30%. For example, if the width of the nose part is 5 metres, the minimum length of the nose part is 8 meters and maximum length of the nose part is 12 meters. In some embodiments, the relation between the width of gliding part, the length of the nose part and the length of the mid-section part is 1:2:5±30%. For example, if the width of the gliding part is 1 metre, the length of the nose part is 2 metres and the length of the mid-section part is 5 metres. Also, these values can vary by 30%. It must be noted that in some embodiments, dimension relationships outside of these ranges may be used, if, for example, optimization of the gliding properties is not required, or if technical requirements of the rocket stage impose restrictions.

In some embodiments the control system of the gliding part 208 comprises two or more gliding support wings. The gliding support wings are positioned inside the frame of the gliding part, attached to the walls of the mid-section part of the gliding part 210. The gliding support wings are discussed in more detail with description of FIG. 5.

In this embodiment, the nose part 209 of the gliding part comprises several movable nose surface parts 219 on the outer surface of the nose part. The nose surface parts are positioned in the rocket stage in such a way that each gliding part 208 comprises at least one nose surface part. The nose surface part functions as a canard arrangement of the gliding part during the glide phase and they can be used to control the glide of the gliding part. In some embodiments the nose surface parts are folded inside the gliding part 208 and are turnable outside of the nose part for improving gliding properties and for providing control mechanisms, such as air brakes.

In some embodiments, the upper surface 217 of the gliding part is at least partly open. In this embodiment, the upper surface is wholly open, i.e. it is a virtual surface. This improves the lift on the gliding part 208 and thus improves its gliding properties. However, in some embodiments the upper surface or inner parts of the mid-section part of the gliding part 210 are covered with some structures. These structures, for example, protect internal system from air currents or improve the structural durability of the gliding part frame. In some embodiment, there is a continuous plate which is parallel to the gliding surface 214 that covers at least part of the gliding surface. The plate covers a segment of the inside of the gliding part. The height of this segment is less than the height of the gliding part. The systems affixed to the gliding part are positioned in this segment and they are protected by the plate.

In some embodiments, the tail end 212 of the gliding part is open. This improves the gliding properties of the gliding part. However, it can be closed at least partially by a wall-like structure without sacrificing too much of the gliding properties. This wall-like structure can be positioned at the tail end or near it. It must be noted that such a transverse wall-like structure may as well be positioned at other places inside the mid-section part of the gliding part 210.

When the frame of the rocket stage has come apart as the gliding parts 208, the separated gliding parts start to descend because they have not reached orbital velocities. The separation height may be at near space or the upper atmosphere. When the gliding parts enter the atmosphere the currents and lifting effects of the frame of the gliding part orient the gliding part in such way that the upper surface of the gliding part faces upward, and the bottom of the gliding part faces downward. The position of the centre of gravity orients the nose end 211 downward. The diving angle decreases when the atmosphere thickens, and the gliding part commences to glide. In some embodiments, the gliding part comprises arrangements that move the centre of gravity by shifting its mass. However, the centre of gravity should stay on the side of the nose at least during most of the glide. The gliding support wings and the movable nose surface parts are used to adjust the gliding position and to steer the gliding part.

Figure 3:
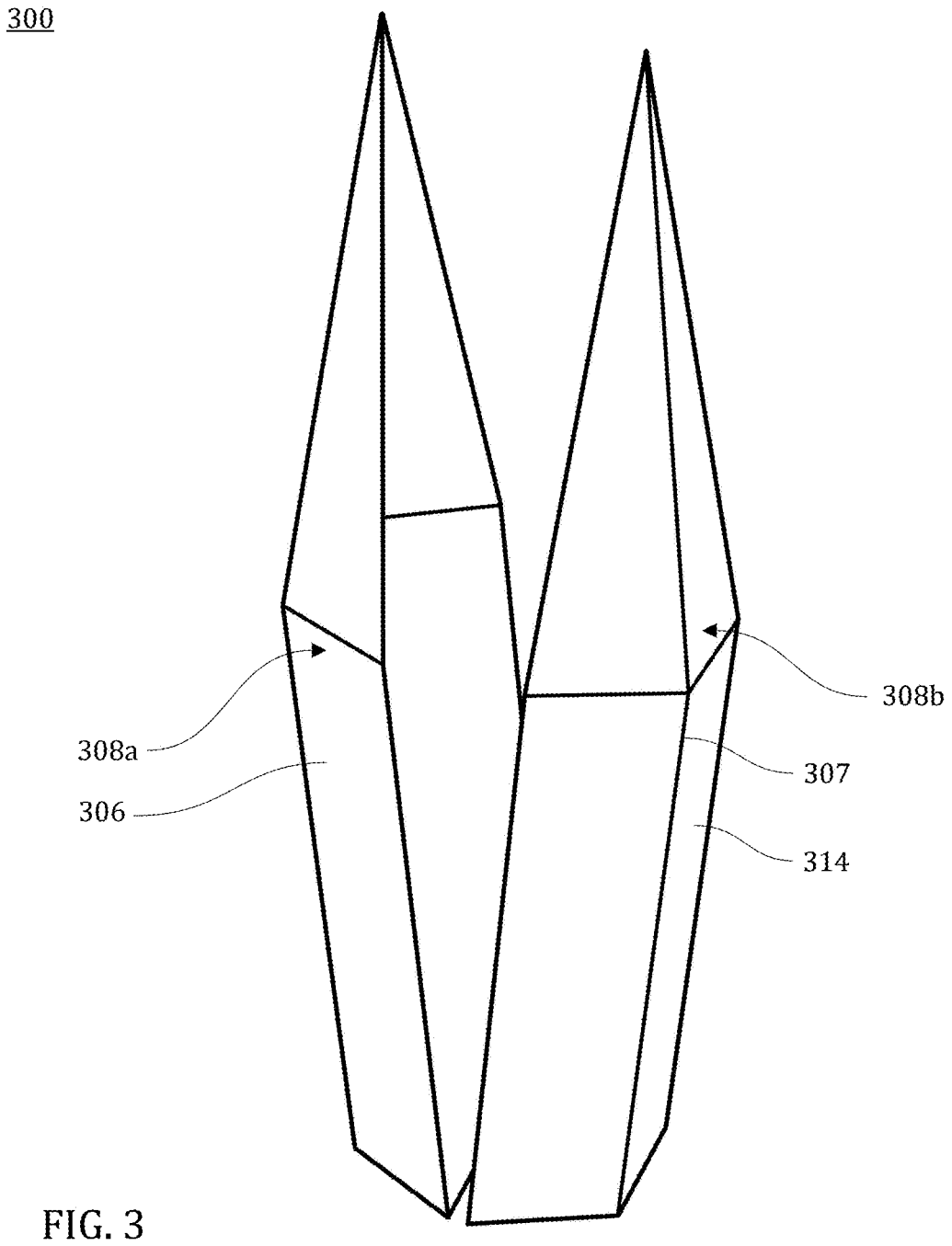
FIG. 3 shows a second example of a rocket stage according to the invention, and the rocket stage comprises two gliding parts.

FIG. 3 shows a second embodiment of a rocket stage 300 having a nose and a tail. The frame of the rocket stage comprises six longitudinal side surfaces 306 having fold lines 307 between its adjacent side surfaces. The fold lines extend from the nose to the tail. The frame of the rocket stage is configured to divide the two gliding parts into a first gliding part 308*a* and a second gliding part 308*b*. Both gliding parts comprise three side surfaces and the middle side surface is a gliding surface 314. In this example, the dividing lines between the gliding parts coincide with the fold lines. In some embodiments, the frame of the rocket stage is configured in such a way that the dividing lines do not coincide with the fold lines. The division should be done in such a way that the gliding surface is symmetrically positioned in the gliding part. In some embodiments, the frame of the rocket stage is constructed in such a way that the edges of the gliding parts at least partly overlap each other when they form the frame of the rocket stage. This means that the gliding parts do not need to be identical.

Figure 4:
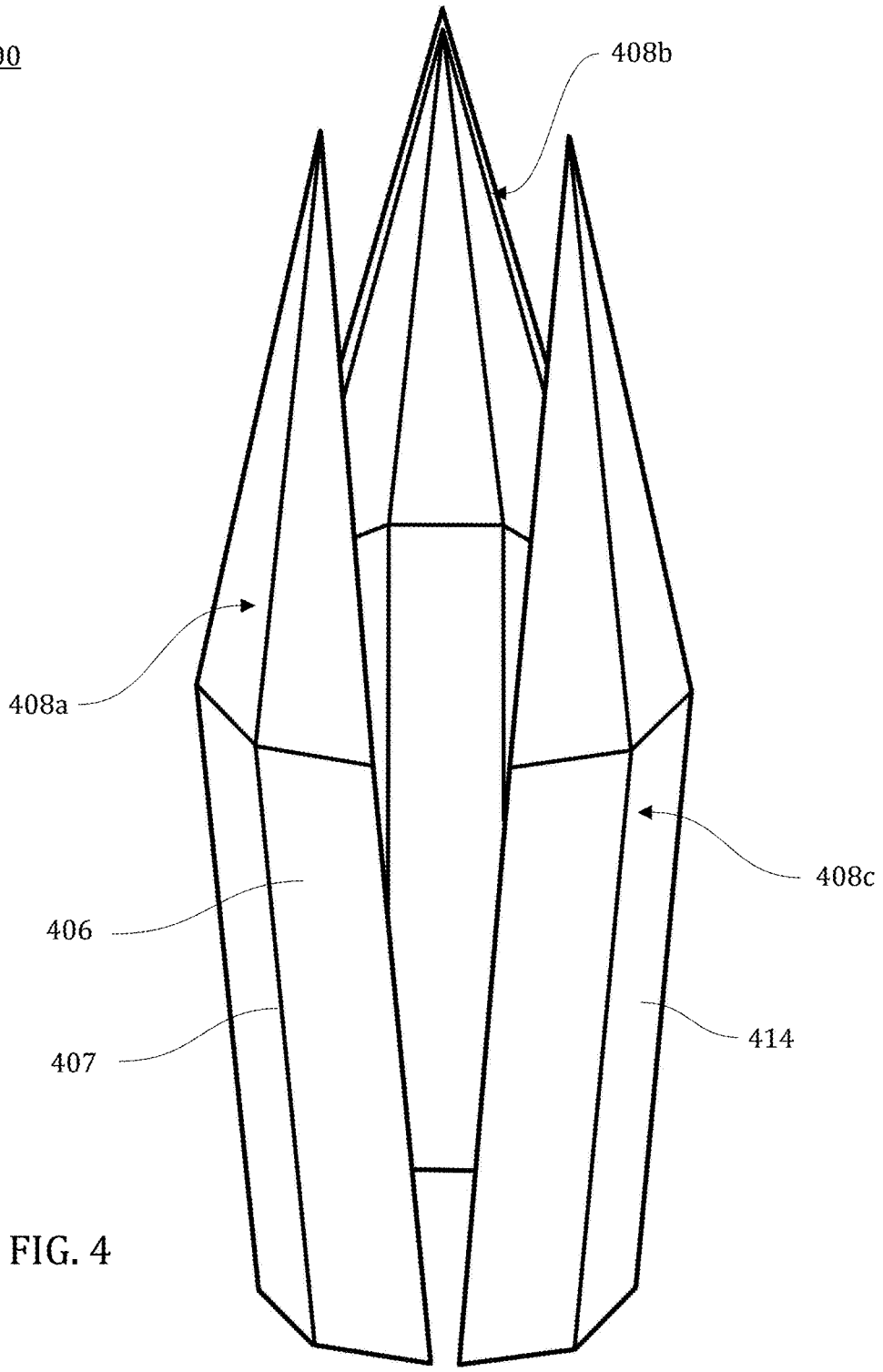
FIG. 4 shows a third example of a rocket stage according to the invention, and the rocket stage comprises three gliding parts.

FIG. 4 shows a third embodiment of a rocket stage 400 having a nose and a tail. The frame of the rocket stage comprises nine longitudinal side surfaces 406 having fold lines 407 between its adjacent side surfaces. The frame of the rocket stage is configured to come apart as three gliding parts: a first gliding part 408*a*, a second gliding part 408*b* and a third gliding part 408*c*. The gliding parts comprise three side surfaces and the middle side surface is a gliding surface 414. There are embodiments where the gliding part comprises more than three side surfaces. In that case the gliding part is configured in such a way that the gliding surface is positioned symmetrically in relation to the other side surfaces on the gliding part.

Figure 5:
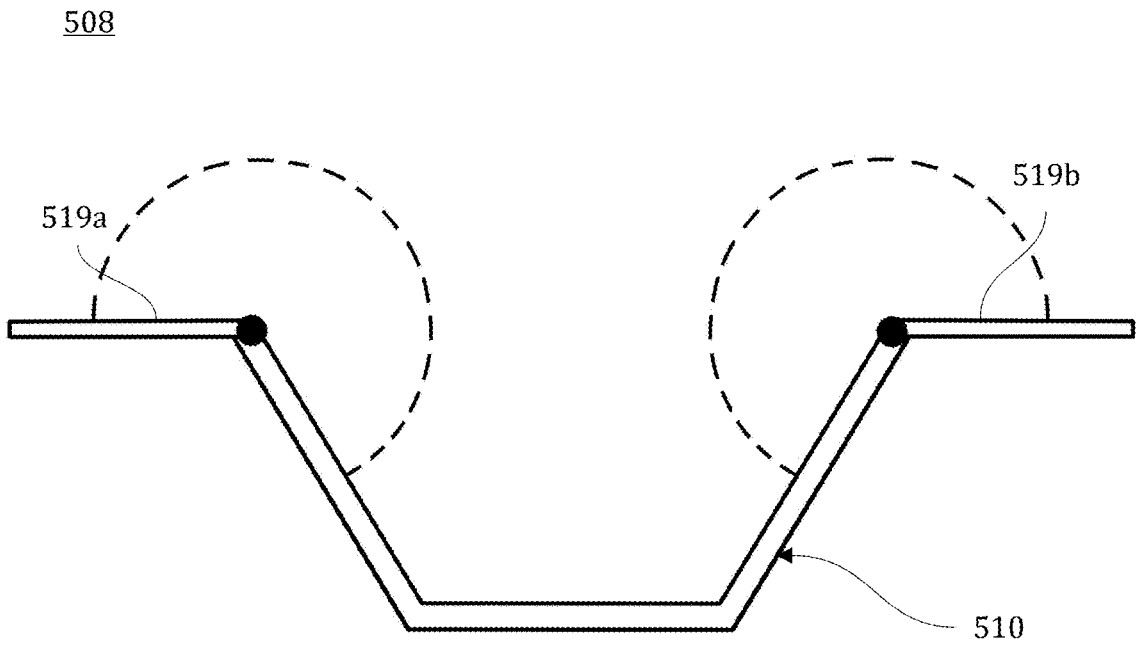
FIG. 5 shows a second example of a gliding part as a transverse cross section.

FIG. 5 shows an embodiment of a gliding part 508 as a cross section of a mid-section part of the gliding part 510. The gliding part comprises two gliding support wings: a first gliding support wing 519*a* and a second gliding support wing 519*b*. Both gliding support wings work as the control system of the gliding part. The gliding support wings are at least partly planar structures. In some embodiments, the gliding support wings are flat. The gliding support wings are positioned in this embodiment inside the frame of the gliding part, and they are attached to the walls of the mid-section part of the gliding part. In some embodiments, the gliding support wings are attached to the outside walls. i.e. outer surface of the mid-section part of the gliding part. The gliding support wings are configured to pivot at least partly outside of the gliding part to provide additional surface area, improving the gliding properties of the gliding part. Also, the gliding support wings can be used to compensate when the dimension relationships are outside of the optimal ranges as described earlier. In some embodiments, the gliding support wings comprise parts that are approximately on the same parallel plane as the gliding surface or diverge 60 degrees at most from the plane of the gliding surface when the gliding support wings are turned out for enhanced gliding properties. In some embodiments, the positions of the gliding support wings or parts of the gliding support wings are adjustable during the gliding process. These features are leveraged for controlling the gliding of the gliding part. Advantageously, the gliding support wings are on the side of the tail. In some embodiments, the gliding support wings are positioned near the tail end. With the term 'near' it is meant that the gliding support wings are not positioned further from the tail end than the longitudinal width of the gliding support wing. The longitudinal width of the gliding support wing is the maximum distance from the nose edge of the gliding support wing to the tail edge of the gliding support wing.

Figure 6:
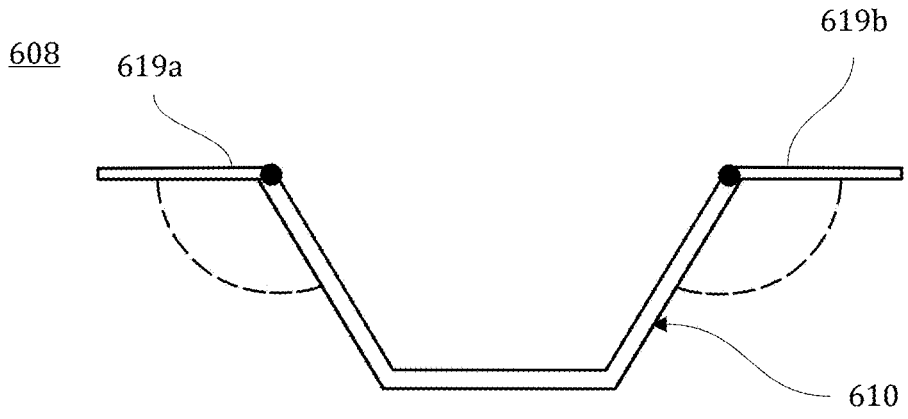
FIG. 6 shows a third example of a gliding part as a transverse cross section.

FIG. 6 shows an embodiment of a gliding part 608 as a cross section of a mid-section part of the gliding part 610. The gliding part comprises two gliding support wings: a first gliding support wing 619*a* and a second gliding support wing 619*b*. This structure is practically similar as was described in FIG. 5, but now the gliding support wings are attached to the outside walls. i.e. outer surface of the mid-section part of the gliding part.

Some advantageous embodiments of the device according to the invention have been described above. The invention is however not limited to the embodiments described above, but the inventive idea can be applied in numerous ways within the scope of the claims. Finally, it should be noted that the description of the invention and the exemplary embodiments are not to be understood as limiting in terms of a particular physical realisation of the invention. The scope of protection of the present invention is given by the claims and is not limited by the features illustrated in the description or shown in the figures.

What is claimed is:

1. A rocket stage, comprising:

an elongated frame, a nose, and a tail, wherein the frame comprises a mid-section part and a nose part comprising a cone shaped surface, and the frame on the mid-section part comprises several longitudinal side surfaces which are approximately flat, wherein the longitudinal side surfaces of the mid-section part and the cone-shaped surface of the nose part together form an aerodynamic lifting body outer contour adapted to enable controlled atmospheric gliding descent of the rocket stage and of gliding parts derived therefrom without active propulsion, the longitudinal side surfaces shaped to generate aerodynamic lift during atmospheric gliding descent, wherein the frame is configured as a structurally load-bearing stage structure and to separate longitudinally into two or more through gliding parts having a nose end and a tail end, each of the gliding parts comprising a section of the nose part and a section of the mid-section part, and each gliding part having a through, at least partly open inner section that, prior to separation, houses stage systems, wherein, for each gliding part, one of the several longitudinal side surfaces of the mid-section part forms a planar or approximately planar gliding surface of the gliding part that, together with the associated section of the nose part, provides primary aerodynamic lift for the gliding part in the atmosphere, the gliding surface arranged symmetrically in relation to edges of the gliding part, wherein geometrical proportions of the nose part and the mid-section part on each gliding part are selected such that a relation between a width of the nose part and a length of the nose part on the gliding part is about 1:2±30% and a relation between a width of the gliding part, a length of the nose part on the gliding part and a length of the mid-section part on the gliding part is about 1:2:5±30%, and wherein a center of gravity of the gliding part, with systems accommodated therein, is closer to the nose end than to the tail end, such positioning adapted, in cooperation with the lifting-body outer countour, to passively orient the gliding part in a stable nose-first gliding attitude during atmospheric descent in the absence of active propulsion, and wherein each of the gliding parts comprises control systems integrated into the nose part and/or the mid-section part and configured to steer or enhance the gliding properties of the gliding part during said atmospheric descent, the control systems comprising at least movable surfaces that are flush or recessed with the frame when the gliding parts together form the rocket stage and that are deployable from the frame to provide control and/or additional lifting or stabilizing surface area during the gliding descent.

2. The rocket stage according to claim 1, wherein angles between longitudinal side surfaces of the mid-section part are approximately equal on a transverse plane.

3. The rocket stage according to claim 1, wherein widths of the longitudinal side surfaces of the mid-section part are approximately equal on a transverse plane.

4. The rocket stage according to claim 1, wherein a relation between a width of the nose part and a length of the nose part on the gliding part is 1:2±30% the relation selected to contribute, in cooperation with the gliding surface, to passive nose-first stabilization of the gliding part during atmospheric glide.

5. The rocket stage according to claim 1, wherein:

a width of the gliding part is a transverse distance between the edges of the gliding part at the mid-section part of the gliding part, and a relation between the width of the gliding part, the length of the nose part on the gliding part and the length of the mid-section part on the gliding part is 1:2:5±30%, wherein the gliding part attains controlled gliding descent without active propulsion using the gliding surface and nose section as primary lifting surfaces.

6. The rocket stage according to claim 1, wherein:

the control systems comprise several gliding support wings affixed to walls of the mid-section part, the gliding support wings are positioned such that at least some of the gliding parts comprise at least two gliding support wings on the opposing walls of the gliding part, and the gliding support wings are stowable substantially flush or recessed within the walls when the gliding parts together form the rocket stage and are deployable to extend at least partly outside of the gliding part so as to provide additional surface area in order to improve the gliding properties of the gliding part.

7. The rocket stage according to claim 6, wherein the gliding support wings are configured such that when the gliding support wings are swung out to improve gliding properties, the gliding support wings comprise parts that are approximately in a same plane as the gliding surface or diverge at most 60 degrees from a plane of the gliding surface.

8. The rocket stage according to claim 6, wherein the gliding support wings are arranged affixed to an inside of the frame and stowable within an interior of the wall, or affixed to an outside of the frame behind fairing doors that close substantially flush with an outer contour of the frame when the wings are stowed.

9. The rocket stage according to claim 1, wherein the nose part comprises several movable nose surface parts arranged on an outer surface of the nose part, the nose surface parts arranged such that each gliding part comprises at least one nose surface part, and the nose surface part configured to function in a canard arrangement for a gliding part during the glide, and the nose surface parts form at least part of the control systems the nose surface parts stowable substantially flush with the nose part when the gliding parts together form the rocket stage.

10. The rocket stage according to claim 1, wherein an included angle between the planes of the nose part and the mid-section part measured relative to a plane of the gliding surface is between 10 to 45 degrees.

11. The rocket stage according to claim 1, wherein the gliding parts are configured and arranged to partly overlap in a load-bearing manner when the gliding parts form the frame.

12. A rocket comprising at least one rocket stage, the at least one rocket stage comprising:

an elongated frame, surfaces shaped to generate aerodynamic lift during atmospheric gliding descent, a nose, and a tail, and wherein the frame comprises a mid-section part and a nose part comprising a cone shaped surface, and the frame on the mid-section part comprises several longitudinal side surfaces which are approximately flat, wherein the frame is configured to separate longitudinally into two or more through gliding parts having a nose end and a tail end, and each of the gliding parts comprises a section of the nose part and a section of the mid-section part and one of several longitudinal side surfaces on the gliding part is a gliding surface, and the gliding surface is arranged symmetrically in relation to edges of the gliding part, and wherein a center of gravity of the gliding parts is closer to the nose end than to the tail end, such positioning being adapted to passively orient the gliding part in a nose-first direction during descent, and each of the gliding parts comprises control systems configured to steer or enhance the gliding properties of the gliding part, the control systems comprising at least movable surfaces stowable substantially flush with the frame when the gliding parts together form the rocket stage and deployable during atmospheric gliding descent.

13. A rocket according to claim 12, wherein the rocket stage comprises systems configured to jettison when the frame of the rocket stage separates into the gliding parts.

14. A gliding part, comprising:

a section of a frame of a rocket stage, a through structure having a nose end and a tail end, a through inner section of the gliding part configured to be at least partly open, a nose part and a mid-section part, the nose part comprising a cone shaped surface part and the mid-section part comprising several longitudinal side surfaces which are approximately flat, the nose part and the longitudinal side surface together forming a lifting-body outer contour, the several longitudinal side surfaces shaped to generate aerodynamic lift during gliding descent, and wherein one of the several longitudinal side surfaces is a gliding surface, control systems configured to steer or enhance gliding properties of the gliding part, the control systems comprising at least movable surfaces that are stowable substantially flush with the nose part and/or mid-section part when the gliding part forms part of the rocket stage and deployable during atmospheric descent, and wherein the gliding surface is arranged symmetrically in relation to edges of the gliding part, wherein the nose part, the gliding surface and the at least partially hollow inner part of the gliding part provide gliding properties for the gliding part in an atmosphere, wherein a center of gravity of the gliding part is closer to the nose end than to the tail end, such CG positioning adapted to passively orient the gliding part in a nose-first direction during descent.

15. The gliding part according to claim 14, wherein the gliding part is configured to land and reuse.

16. The rocket stage of claim 1, wherein the nose part, mid-section part, and gliding surface together form an aerodynamic shape adapted to enable controlled gliding descent without active propulsion.

* * * * *